29-605 SR
10/22/85 XR 4,548,365

United States Patent [19]

Marzec et al.

[11] Patent Number: 4,548,365

[45] Date of Patent: Oct. 22, 1985

[54] METHOD AND APPARATUS FOR WINDING TOROIDAL CORES

[75] Inventors: Willy Marzec, San Diego; Allen A. Tallis, Oceanside, both of Calif.

[73] Assignee: Varian Associates, Palo Alto, Calif.

[21] Appl. No.: 610,448

[22] Filed: May 15, 1984

[51] Int. Cl.[4] ..... H01F 41/08

[52] U.S. Cl. ..... 242/4 R; 29/605

[58] Field of Search ..... 24/4 R, 4 A, 4 B, 4 C; 29/605

[56] References Cited

U.S. PATENT DOCUMENTS

| | | | |
|---|---|---|---|
| 3,132,816 | 5/1964 | Oshima | 242/4 |
| 3,985,310 | 10/1976 | Kent et al. | 242/4 R |
| 4,288,041 | 9/1981 | Marzec et al. | 242/4 R |
| 4,381,600 | 5/1983 | Mas | 242/4 R |

FOREIGN PATENT DOCUMENTS

| | | | |
|---|---|---|---|
| 482319 | 12/1975 | U.S.S.R. | 242/4 A |

*Primary Examiner*—Billy S. Taylor

*Attorney, Agent, or Firm*—Brown, Martin & Haller

[57] ABSTRACT

A method and apparatus for winding toroidal cores is disclosed whereby two wire strands supplied from a continuous source are successively wound into turns about different angular sectors of a toroidal core to form two coils that are wound in different directions. The first strand is fed through the core opening in a position along a first sector of the core that is located slightly clockwise from the position in which the first turn of the first coil is being formed, and it is then wrapped around and through the core opening in successive turns as the core is rotated clockwise to form a first coil wound in a first direction. The second strand is then fed through the core opening from a position along a second angular sector of the core that is located slightly counterclockwise from the position in which the first turn of the second coil is being formed, and it is then wrapped around and through the core opening in successive turns as the core is rotated counterclockwise to form a second coil wound in the opposite direction.

8 Claims, 24 Drawing Figures

METHOD AND APPARATUS FOR WINDING TOROIDAL CORES

BACKGROUND OF THE INVENTION

The present invention relates to method and apparatus for winding successive convolutions of one or more continuous strands of material onto a workpiece. More particularly, it concerns an improved method and apparatus for successively winding multiple strands of wire about different angular sectors of ring-shaped articles such as toroidal cores, the different sectors being wound in different directions.

As used herein, the term "core" means a ring-shaped article having the plane closed curve cross section of a toroid, or any one of various other different cross sections. The term "wire" as used herein means any material in the form of a flexible strand which is not so supple that it buckles easily when pushed from one end in a length-wise direction. The terms "continuous wire supply" and "continuous wire source" mean that the length of continuous wire in the supply coil or source is sufficiently long to enable a plurality of cores to be wound from the supply or source before the wire is used up. As used herein, the term "oval-shaped" refers to a closed curve having opposite ends with different radius of curvature.

Wire wound ferrite cores have been used as electronic components for many years. They are particularly adapted for producing a gapless magnetic field. Inductance coils and transformers can be constructed in this manner. Rheostats can be constructed with cores wound with resistance wire. Very small wire wound cores have also been used as memory elements in computers.

Heretofore, the wire has often been wound onto such cores by hand. This process is time consuming and tedious and frequently results in inferior coils due to non-uniform spacing of the wire turns around the core. More recently, the wire has been wound onto such cores through the use of a rotating winding ring or shuttle which carries several loops of wire and rotates at high speed through the central aperture of the core. U.S. Pat. No. 2,810,530 discloses an exemplary apparatus for winding cores in this manner. Such apparatus require the constant attention of an operator who must mount each core, manually wind the appropriate number of loops of wire about the shuttle, and remove the core from the shuttle upon the completion of the winding operation.

Improved winding apparatus have been developed which do not require the insertion of a winding ring or shuttle, or any other element through the central aperture of the core. Instead, a coil of wire is formed which extends through the central aperture of the core. Individual turns about the core are made from the loops of the coil during continuous rotation of the coil. One such apparatus is disclosed in U.S. Pat. No. 3,132,816. In that apparatus, loops of wire are held frictionally between the engaging faces of two ring-like belts which are rotatably driven about their central axes. The wire loops pass through the center of a core supported between separated portions of the belts. The trailing end of the wire is rigidly held so that as the coil rotates the wire loops are wound into turns about the core.

U.S. Pat. No. 3,985,310, owned by the assignee of the present application, discloses a shuttleless core winding apparatus in which a length of wire is fed into a radially inwardly facing annular channel through a curved feeding tube. The wire is propelled about the channel by two pairs of driven pinch rollers to form a number of radially spaced circular loops. The upper and lower boundaries of the channel maintain the loops in a single concentric layer. A gap is provided in the channel for receiving the core so that as each circular loop is formed, the wire in that loop passes through the core opening. When enough wire has been fed, the trailing end of the wire is held. The circulation of the loops through the core opening continues and each loop is shrunk into turns about the core, one new turn being completed for each circulation of the loops about the annular channel. The winding of two or more wires simultaneously around the core (known as bifilar and multi-filar winding) can be accomplished by the apparatus of U.S. Pat. No. 3,985,310.

The apparatus of U.S. Pat. No. 3,985,310 has certain limitations. Because the wire loops are formed into a single concentric layer within the circular channel, provisions must be made to ensure that each loop is driven around the channel at an angular velocity which is equal to or greater than that of any loop radially outwardly of it. If the angular velocity of any inner loop is less than that of any outer loop, the inner loops circulate around the channel more slowly and get larger and jam against the outer loops, preventing proper winding of the core. To avoid this result, the driven pinch rollers are not cylindrical but instead are beveled and supported at an angle to each other. Roller wear and inprecise positioning of the rollers can result in an improper speed relationship between the concentric wire loops, and this will often terminate the winding operation.

Furthermore, the loop capacity of the apparatus of U.S. Pat. No. 3,985,310 is relatively small and this places an upper limit on the number of turns that can be wound around the core. If too many loops are formed within the channel of the apparatus, it is difficult to maintain the required radial speed relationship. This often results in jamming or buckling of the loops. The opposing pairs of driven pinch rollers are not well suited for providing sufficient positive driving force to enable heavier gauge wire to be wound around larger cores. Winding with heavier wire also requires positive guidance of the wire on both its inner and outer boundaries as the loops are formed and circulated. The apparatus of U.S. Pat. No. 3,985,310 has no inner boundary guidance.

Many of the shortcomings of the aforementioned prior art devices were overcome by the apparatus disclosed in U.S. Pat. No. 4,288,041, also owned by the assignee of the present application. That patent discloses a shuttleless toroidal core winder apparatus which includes a U-shaped wire receiving channel having a semi-circular portion with a gap and a pair of openended legs. The ends of the channel legs are positioned adjacent opposite sides of a rotatably mounted drum which is driven by a resilient endless belt engaging approximately one-half of its annular outer surface.

In the device of U.S. Pat. No. 4,288,041, a toroidal core is supplied and rigidly supported in the gap by a core feeding mechanism. A grooved gap crosser is thereafter extended through the central opening of the core to bridge the gap and complete the channel. A pair of pinch roller type feed/brake mechanisms propel and guide the leading ends of the wires into the channel, through the core opening, and up one channel leg to the drum. There the wires are frictionally held between the drum and the belt and they are positively driven into the other channel leg, through the core opening, and back to the drum. Continued feeding of the wire results in the formation of a coil having a plurality of vertically stacked loops which extend through the core opening and are alternatively made of different ones of the wires. Thereafter, staggered braking of the trailing ends of the wires causes the loops to be successively peeled radially inwardly from the channel and the drum as the coil is continuously circulated. The loops are shrunk and tightened into turns about the core as it is slowly rotated about its axis by the core feeding mechanism. First and second shear mechanisms cut off the trailing and leading ends of the wires at the beginning and end of the winding operation, respectively.

The apparatus of U.S. Pat. No. 4,288,041 has been used commercially on an extensive basis with a high degree of reliability at a high rate of production. However, it is only capable of winding one or more strands of wire in one direction about one angular sector (portion of the circumference) of a toroidal core such as illustrated in FIG. 4 herein. In the field of electronics, there are many uses for a ferrite core having two wire windings on different angular sectors of the core, the windings being in opposite direction or sense. In other words, one winding on one sector of the core is wound in a reverse direction with reference to a second winding on another sector of the core. This type of winding is referred to herein as "multiple reverse sector winding", an example of which is illustrated in FIG. 5 herein. None of the aforementioned prior art apparatus is capable of winding toroidal cores in this fashion, including U.S. Pat. No. 4,288,041.

SUMMARY OF THE INVENTION

The primary object of the present invention is to provide an improved method and apparatus for winding toroidal cores.

Another object of the present invention is to provide an improved shuttleless toroidal core winder which is capable of multiple reverse sector winding.

Another object of the present invention is to provide such an apparatus with a wire guide track configured to reduce the amount of wasted wire.

Another object of the present invention is to provide a shuttleless toroidal core winder with an improved core loading and rotating mechanism.

According to the preferred embodiment of the invention, first and second wire strands are successively wound into turns about different angular sectors of a toroidal core, the turns of the wires being wound in different directions. An oval-shaped wire guiding channel is provided with a gap into which a core is positioned by a core feeding mechanism. A gap crosser thereafter extends through the central opening of the core to complete the wire feeding channel. A first strand of wire from a continuous source is fed into the channel through the core opening and is positively driven around the channel by a drum and endless belt combination. A coil of the first wire is thus formed consisting of a plurality of vertically stacked loops, each of which circulates through the central opening of the core. The first wire is fed into the channel from a location outside the channel on one side of the plane of the coil. The trailing end of the first wire strand is then braked, causing loops of the wire to successively peel out of the channel and to be shrunk into turns which are tightened about the core as the core is rotated. The trailing and leading ends of the first wire are cut. The second wire strand is fed into the channel through the core opening from a location inside the channel on the other side of the plane of the coil. A coil of the second wire is thus formed consisting of a plurality of vertically stacked loops which circulate through the core opening. The trailing end of the second wire strand is then braked, and the core is rotated in an opposite direction. Loops of the second wire successively peel out of the channel and are shrunk into turns about the core, the turns of the second wire being wound in a direction opposite to the turns of the first wire. The trailing and leading ends of the second wire are cut, and the completed wound core is ejected.

DESCRIPTION OF THE PREFERRED EMBODIMENT

Figures 1, 2:
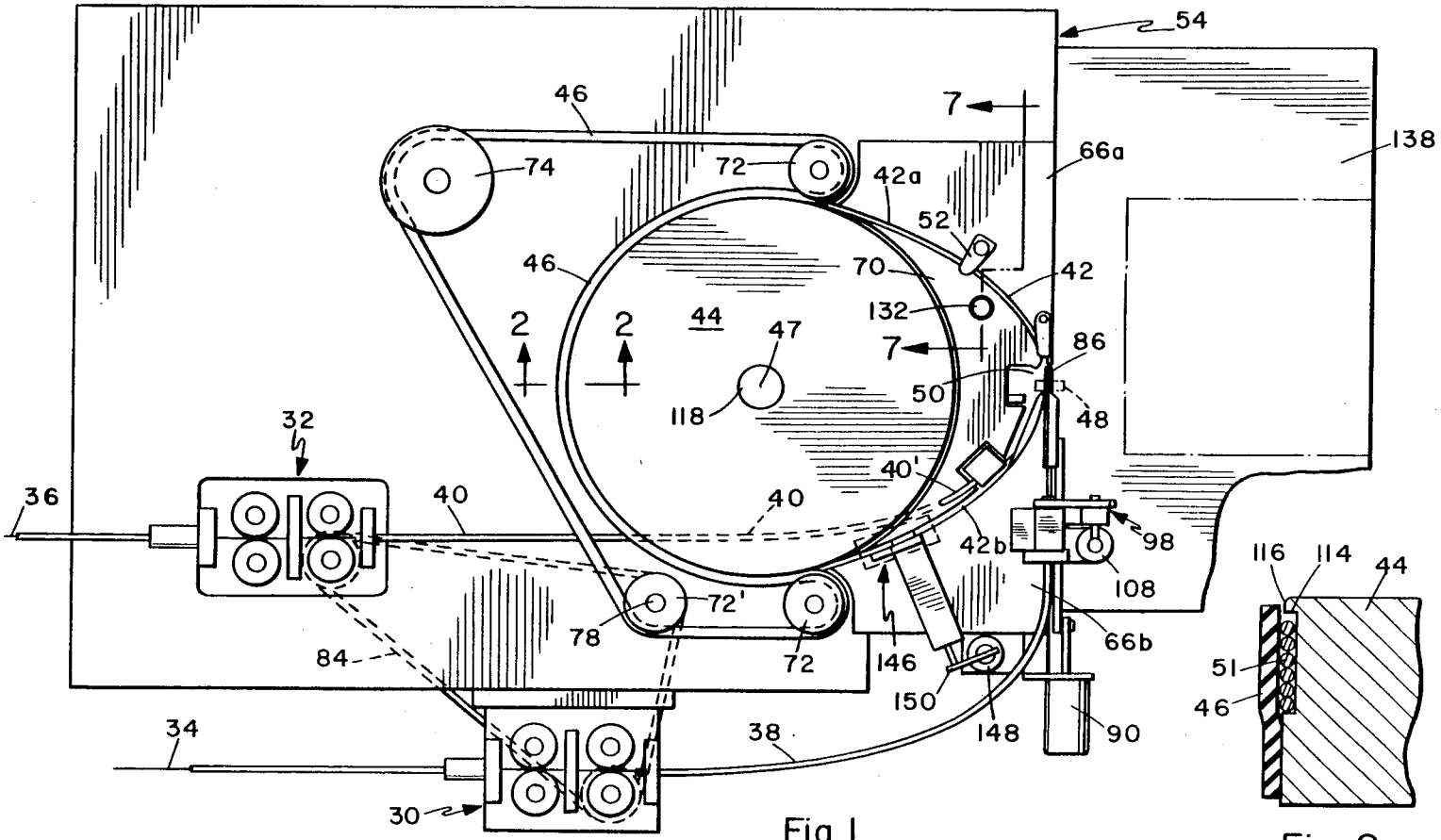
FIG. 1 is a top plan view of a preferred embodiment of the apparatus, excluding the core feeding mechanism.
FIG. 2 is a greatly enlarged vertical sectional view taken along line 2—2 of FIG. 1 illustrating a plurality of vertically stacked loops of wire wound about the drum of the apparatus and engaged by the resilient drive belt.

Referring to FIG. 1, the illustrated embodiment of the shuttleless toroidal core winder includes wire feeding and braking means 30 and 32 for feeding first and second wire strands 34 and 36, respectively, from different continuous wire sources such as large wound spools (not shown). The feeding and braking means have powered opposing pinch rollers for driving the wire strands through curved metal guide tubes 38 and 40. The wires are fed through the guide tubes into the smaller radius end of an oval-shaped wire receiving channel 42 formed by a series of metal plates as hereafter described. Open-ended legs 42*a* and 42*b* of the channel are positioned adjacent opposite sides of a relatively large drum 44. Endless belt means 46 engage a portion of the outer surface of the drum for drivingly rotating the same about its vertical axis 47. The wire strands are fed through the central opening of a toroidal core 48 rigidly supported in a gap 50 in the small radius portion of the oval-shaped channel. The core is supported by a core feeding mechanism not shown in FIG. 1 but illustrated in detail in FIGS. 12–16. The core 48 is supported in the gap so that its central axis is perpendicular to the rotational axis 47 of the drum 44.

For reasons that will become more apparent hereafter, in order to accomplish multiple reverse sector winding, the first wire 34 is fed through the guide tube 38 tangentially into the midpoint of the small radius portion of the oval-shaped channel 42 at the location of the gap 50. The guide tube 38 extends above the channel 42 in drum 44 and its feed end descends into the channel from a location outside the channel. By contrast, the second wire 36 is fed through the guide tube 40 initially underneath the channel 42 and drum 44 as illustrated by the phantom lines in FIG. 1. The guide tube 40 curves upwardly so that its feed end 40° extends through the plates which define the channel 42 to feed the second wire into the channel 42 at a location ahead of the point where the first wire is fed into the channel. Thus, the second wire feeds into the channel from a location underneath and inside the channel.

The first wire strand is fed into the channel, formed into a coil, wound on the core and then cut. Thereafter, the second wire strand is fed into the channel, wound onto the core and then cut. Therefore, the first and second strands of wire are not in the channel at the same time. As each strand of wire is fed into the channel, it is frictionally held between the outer cylindrical surface of the drum 44 and the belt means 46. As the wire continues to feed into the channel, a coil 51 (FIG. 2) of wire consisting of a plurality of generally oval-shaped vertically stacked loops is formed, each loop extending through the central opening of the core 48.

Figure 19:
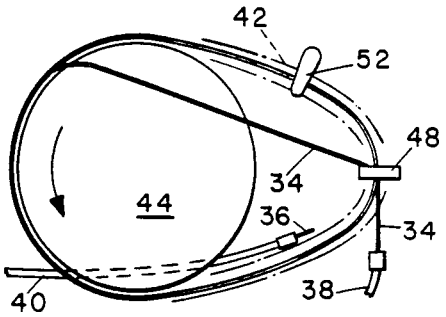
FIGS. 19–24 are a series of views that illustrate multiple reverse sector winding of a toroidal core.
Figure 20:
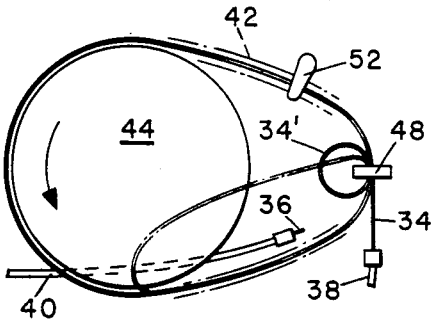

Considering for the moment the feeding of the first wire strand into the channel, when enough oval-shaped loops have been formed, the trailing end of the strand is rigidly held by the feeding and braking means 30. However, continued rotation of the drum 44 by the belt means 46 causes the uppermost loop in the channel to peel radially inwardly out of the channel and away from the drum as illustrated in FIGS. 19 and 20. One new turn of the first strand of wire is thereafter shrunk and tightened onto the core for each successive revolution of the coil and resulting peeling away of a loop. An adjustable wire release means 52 above the channel 42 as well as guide mechanisms which deflect the wire adjacent the core ensure that each turn is suitably tightened onto the core before the next loop peels away.

Figure 4:
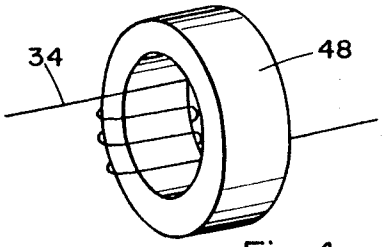
FIG. 4 illustrates a toroidal core with a single wire wound in one direction about one angular sector of the core.

During this process, the core 48 is rotated about its central axis by the core feeding mechanism so that the first strand of wire is wrapped around a first sector of the core as illustrated in FIG. 4. The trailing end of the first wire strand can be cut off any time after the first turn has been tightened around the core since one end of the wire will then be anchored about the core and continued circulation of the coil by the drum and belt means will maintain the peeling action. To prevent slippage, more turns may be required before the trailing end is cut off. It is necessary to feed more wire into the channel than will be wound about the core. The first loop formed in the channel is the last to be wound about the core and at the conclusion of the winding operation, the leading end of the first strand of the wire constitutes an excess and it is cut off.

The manner in which the apparatus of the present invention winds the first strand of wire onto the toroidal core is generally similar to that described in U.S. Pat. No. 4,288,041. A more intuitive understanding of the principals of the coil formation, peeling away, and turn tightening may be obtained from a thorough reading of U.S. Pat. No. 4,288,041, the entire disclosure of which is incorporated herein by reference. The apparatus of U.S. Pat. No. 4,288,041 is only capable of winding wire in one direction around the core. In addition, the wire channel that forms the wire coil in the apparatus of U.S. Pat. No. 4,288,041 consists of two semi-circular sections of equal diameter connected by two straight leg segments. The oval-shaped configuration of the channel 42 of the present invention has a smaller radius segment at the gap end, opposite the drum, and shorter segments connecting the smaller radius segment to the segment extending around the drum. The advantage of this new configuration is that a significant reduction of the amount of waste wire results, which can produce tremendous savings when thousands of cores are being wound.

Figure 17:
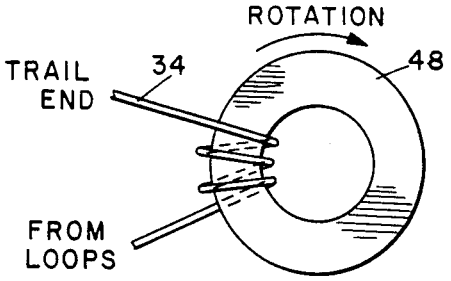
FIGS. 17 and 18 are simplified diagrams of a toroidal core illustrating how different wires can be wound in opposite directions about an angular sector of the core.

So in summary, and referring to FIG. 17, the sequence of events for winding the first wire about the core is as follows. The wire is fed into the oval-shaped channel 42 and is formed into a coil having a plurality of loops which circulate through the core opening. The trailing end of the first wire is then braked. The coil of the first wire and the large loops thereof continue to circulate through the core opening. With each revolution of the loops, and while the core is being slowly rotated, a turn of the first wire is shrunk and tightened on the core, these turns wrapping around the core in the direction illustrated in FIG. 17. The core is rotated about its central axis to position the core for each successive turn of the first wire. As illustrated in FIG. 17, each successive turn of the first wire is formed below the previous turn as the core rotates in a clockwise direction. The trailing end of the first wire can be cut immediately after the first turn is shrunk since this also accomplishes braking action which can be utilized in lieu of the braking action of the feeding and braking means 30. The leading end of the first wire is excess which is cut off after the winding of the first turn is completed.

Figure 18:
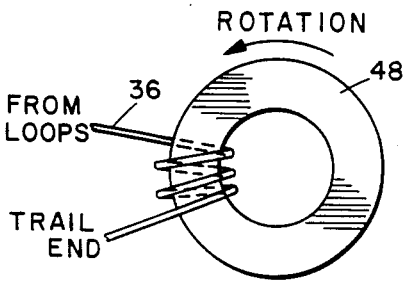

The second wire can now be wound in the reverse direction about the core about a different angular sector thereof as follows. In reverse winding, each successive turn is formed above the previous turn as the core is rotated about its central axis in a counter-clockwise direction as illustrated in FIG. 18. In order to start the reverse wound sector, the first loop of the second wire must shrink above the trailing end of the second wire. To accomplish this, the wire is fed into the channel 42 from below the plane of the loop by the guide tube 40 (FIG. 1) so that the first loop of the second wire tightens above the trailing end of the second wire. Subsequent turns of the second wire are formed correctly because the core rotates in a counter-clockwise direction to rotate the wound turns down below the plane of the remaining loops of the second wire. It should be understood that upon completion of the winding of the first wire onto the core, the core feed mechanism preferably rotates the core so that the second wire is wound over a different angular sector of the core without overlapping the first wire winding.

Three other approaches that might be used to perform multiple reverse sector winding are as follows. The second wire strand could be fed through the core from the side thereof opposite the side through which the first wire strand was fed. The core could then be rotated in the same direction during winding of both the first and second wire strands. However, this arrangement would require a second guide tube on the opposite side. More importantly, this approach would require reversal of the wire direction in the guide channel, and a reversal of the direction of rotation of the drum. Such an approach would be impractical to mechanize. A second alternate approach would be to stop the apparatus after winding the first wire strand in order to flip over the core and then feed the second wire strand through the same mechanism as the first wire strand, but in an apparent opposite direction to the first wire strand. Such an approach would also be difficult to automate. A third alternate approach would be to construct the apparatus with two separate drum and wire guide channel combinations opposite the same gap where the core is located. But the resulting apparatus would leave very little room for the core feeding mechanism and would entail much duplication of parts.

Figure 3:
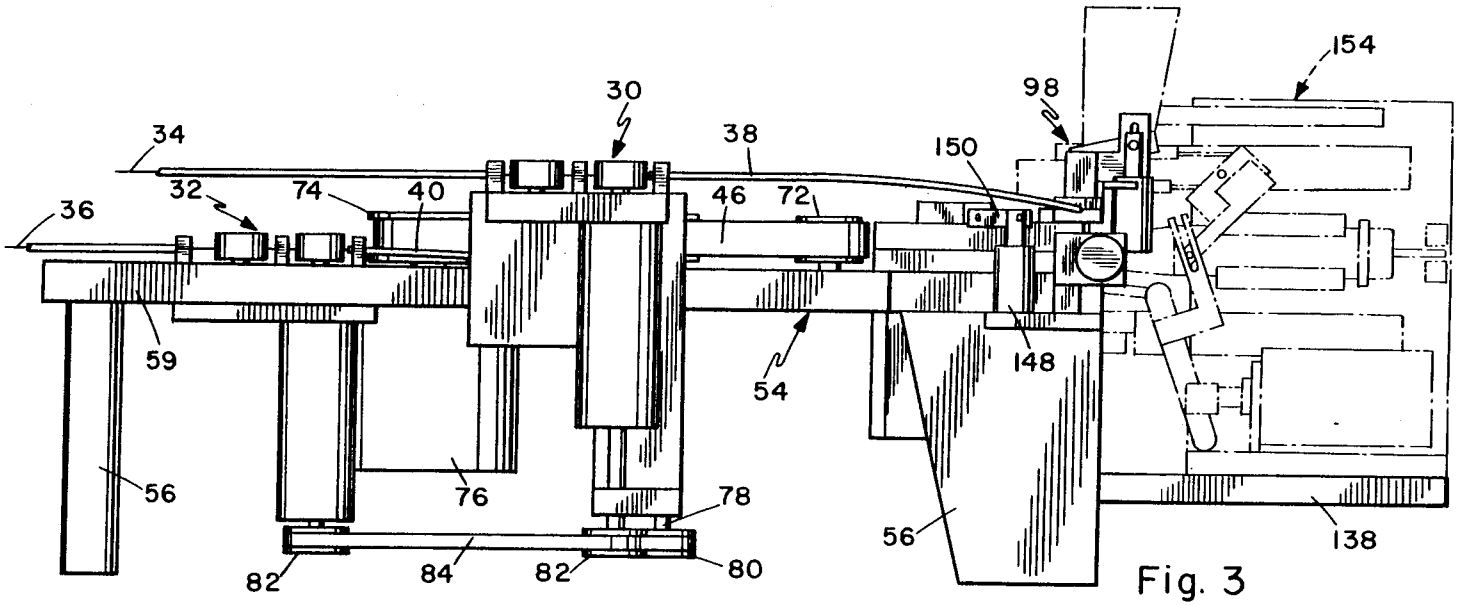
FIG. 3 is a side elevation view of the apparatus of FIG. 1, showing the core feeding mechanism in phantom lines.
Figure 5:
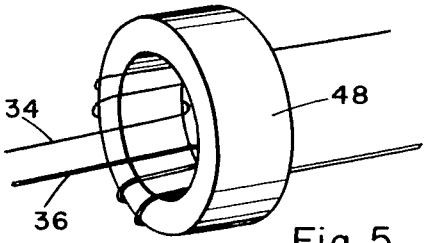
FIG. 5 illustrates a toroidal core with a first wire wound in one direction about one angular sector, and a second wire wound in the opposite direction around a second angular sector of the core.
Figure 6:
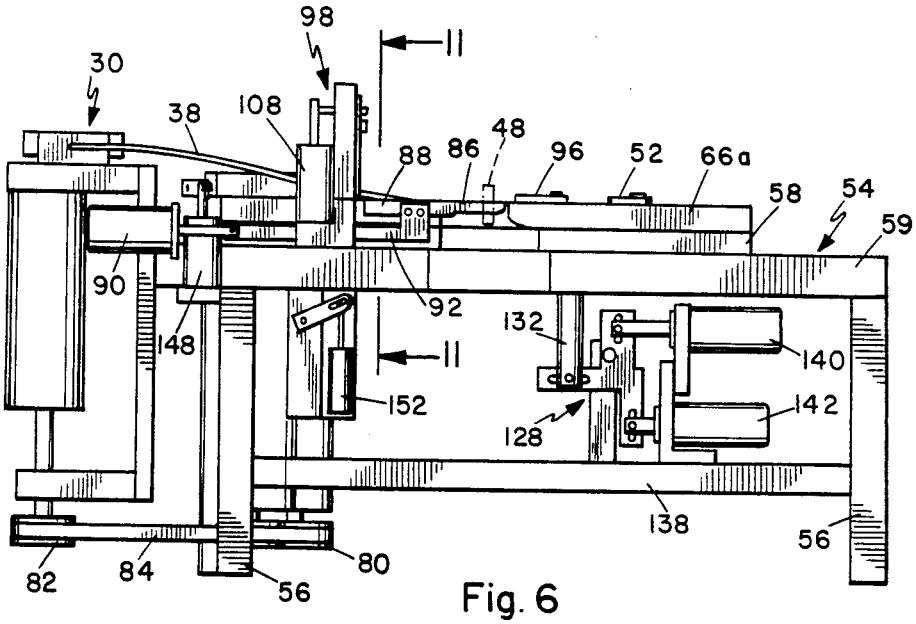
FIG. 6 is a front end elevation view of the apparatus of FIG. 1, taken from the right hand side of FIG. 3. The core feeding mechanism is not shown in this view.

The construction and operation of the illustrated embodiment of our invention may now be described in detail. As illustrated in FIGS. 3 and 6, the operative mechanisms of the apparatus are supported by a platform structure 54 which may be constructed from interconnected vertically and horizontally extending planar sections of aluminum or other suitable rigid material. The platform structure includes legs 56 and horizontal base plates 58 and 59 which are supported by the legs.

The platform structure 54 includes means for defining the generally oval-shaped wire receiving channel 42. A pair of similarly formed planar guide plates **66*a* and 66*b* (FIG. 1) are secured in overlapping relationship with the forward corners of the upper base plate 58. The forward ends of the guide plates are spaced apart to define the gap 50. The guide plates 66*a* and 66*b* are formed with curved inner vertical faces, which oppose a similarly curved vertical face of a central, generally crescent-shaped guide plate 70 (FIG. 1) secured over the upper base plate 58 between the triangular-shaped guide plates 66*a* and 66*b*. The gap between the guide plates 66*a* and 66*b* on the one hand and the guide plate 70 defines the smaller radius portion, and the generally straight segments 42*a* and 42*b* of the oval-shaped wire guide channel 42. The crescent-shaped guide plate 70 has a curved vertical outer surface of the same radius of curvature as the drum 44**.

The drum 44 (FIG. 1) is rotatably mounted on the platform structure 54 such that its curved outer surface is closely adjacent to the similarly curved surface of the crescent-shaped guide plate 70. The segments of the channel 42 defined between the guide plates **66*a*, and 66*b* and 70 extend and terminate at locations tangential to the outer cylindrical surface of the drum 44. Thus, wire fed into the channel 42 can be driven into loops around the drum and between the guide pieces by the belt means 46**.

The belt means 46 (FIG. 1) is entrained about idler pulleys 72 and about a drive pulley 74. The drive pulley 74 is mounted on the upper end of the shaft of a relatively large electric motor 76 (FIG. 3). One of the idler pulleys 72' is mounted on a shaft 78 which extends through the platform structure and has a pulley 80 (FIG. 3) mounted to its lower end. One pinch roller from each of the wire feeding and braking means 30 and 32 is mounted on the upper end of a shaft whose lower end is rotated by a pulley such as 82. A second resilient endless belt 84 (FIGS. 1 and 3) is entrained around the pulleys 80 and 82. Through this arrangement, the wire feeding and braking means 30 and 32 feed the first and second strands of wire into the guide channel 42 at the same velocity that the outer surface of the drum 44 is travelling. This arrangement ensures smooth formation of the coil of wire loops within the channel 42.

Preferably the channel 42 formed by the guide plates has a uniform cross sectional area throughout its length. It is also necessary that the channel have a width of from more than one and less than two times the diameter of the wire which is fed into the channel so that the loops formed therein will be vertically stacked. The illustrated embodiment of our apparatus is set up for monofilar sector winding. This means that the loops of the coil which rest within the channel and surrounds the drum 44 are formed from either the first wire strand 34 or the second wire strand 36. The height of the channel 42 is preferably sufficient to accommodate a coil formed from the strand of wire which is sufficient in length to enable the desired number of turns to be formed about the toroidal core.

Gap crosser means are provided for selectively bridging the gap 50 (FIG. 1) to complete the wire guiding channel 42. A gap crosser 86 (FIGS. 6 and 9) in the form of a relatively small finger-like projection is integrally formed to one end of an elongate mounting bar 88. The rear end of the mounting bar can be moved from a retracted position to an extended position for selectively bridging the gap 50 to complete the channel 42 by a solenoid 90 (FIG. 6). The actuating rod of the solenoid 90 is connected to the mounting bar 88 by a bracket 92.

Figure 9:
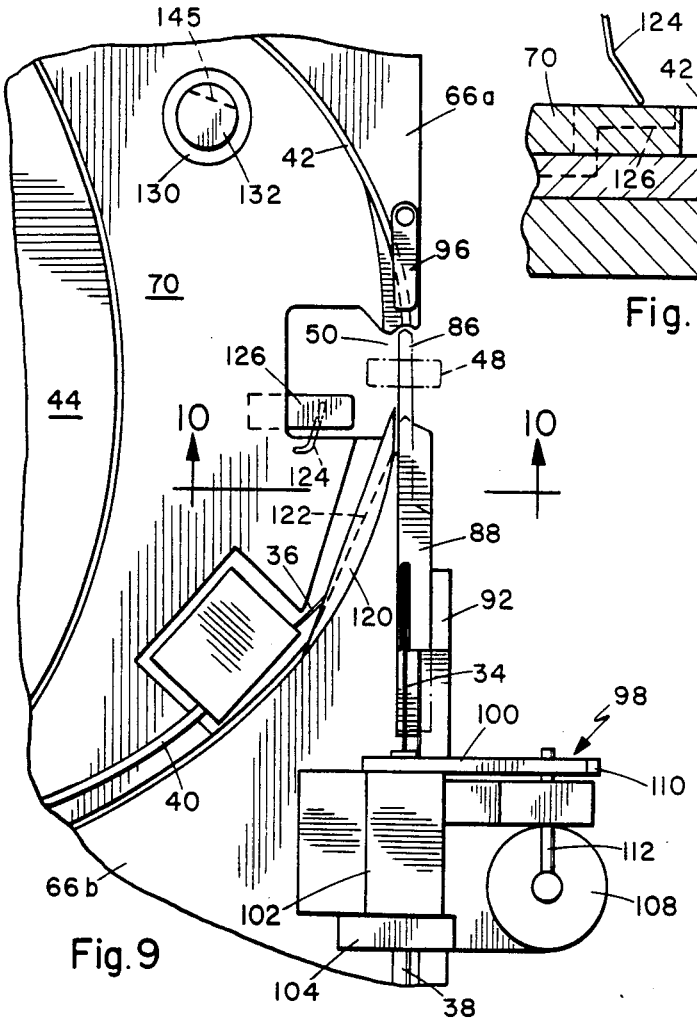
FIG. 9 is a greatly enlarged, fragmentary, top plan view of the front end portion of the apparatus of FIG. 1, with the core feeding mechanism not shown in order to clearly illustrate the manner in which the first and second strands of wire are fed into the wire guide channel and through the core.

When the gap crosser is in its retracted position, the core 48 can be moved into the gap in position for the winding operation or removed from the gap after the completion of the winding operation. As illustrated in FIGS. 6 and 9, the gap crosser 86 is small enough in width and height to provide sufficient clearance so that the turns of wire can be wrapped about the core.

Figure 10:
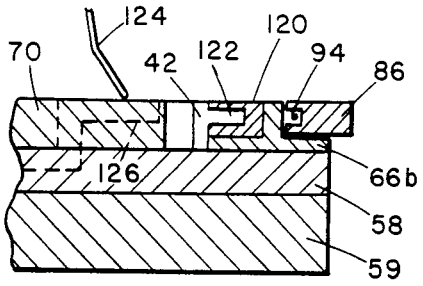
FIG. 10 is a greatly enlarged, fragmentary vertical sectional view taken along line 10—10 of FIG. 9.

A tangential slot 94 (FIG. 10) is formed in the gap crosser 86 at the center point of the core 48. The slot 94 is located so as to coincide with the same depth as the wire guiding channel 42. To ensure that the first wire 34 enters the slot 94 smoothly, a guide member 96 (FIG. 9) made of DELRIN (trademark) or other suitable material is mounted on guide plate 66*a* in such a manner as to guide and constrain the first wire 34 between the guide tube 38 and the wire guiding slot 42.

Figure 11:
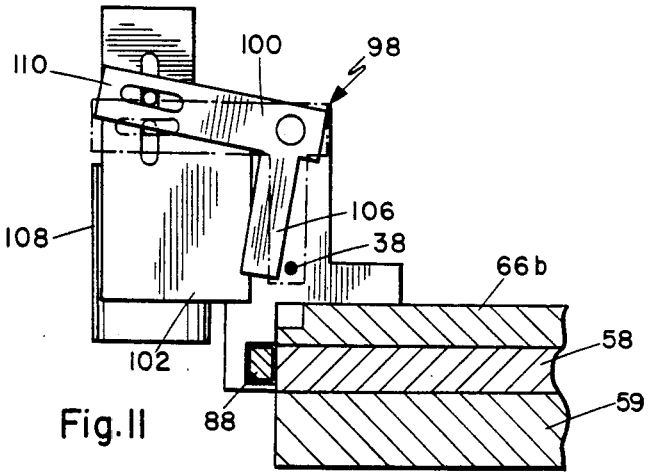
FIG. 11 is an end elevation view taken along line 11—11 of FIG. 6 and illustrating the shear mechanism which cuts the trailing end of the first wire.

First shear means 98 (FIGS. 9 and 11) are provided for cutting the trailing end of the first wire 34. A L-shaped knife 100 (FIG. 11) is rotatably mounted in overlapping relationship with one face of a block 102 supported on the corner of the guide plate 66*b*. The guide tube 38 extends through a bracket 104 and through the block 102. The forward end of the guide tube 38 terminates flush with the face of the block 102 which is overlapped by the blade portion 106 of the knife 100. The knife is rotated to shear the first wire 34 by a solenoid 108 (FIG. 9) whose actuating arm is connected to the leg portion 110 (FIG. 11) of the knife through a linkage 112.

A second shear means is provided for cutting the trailing end of the second wire adjacent the feed end of the guide tube 40. The second shear means is not visible in the drawing but is similar in construction to the first shear means.

The outer surface of the drum 44 is formed with an annular recess 114 (FIG. 2) corresponding in height to the height of the wire guiding channel 42. This recess is positioned at the same level as the channel and receives the coil 51 therein. The upper periphery of this recess is bounded by an upper lip 116. The lip 116 serves to retain the coil 51. However, the rounded configuration of the lip facilitates the peeling away of the loops from the drum 44.

The drum 44 (FIGS. 1 and 2) has a relatively flat, cylindrical configuration. It roughly corresponds in thickness to the thickness of the guide plates 66*a* and 66*b*. The drum is mounted for rotation about a vertical axis in overlapping relationship with the upper base plate 58 and is positioned thereon adjacent to the ends of the guide plates 66*a*, 66*b* and 70 so that the coil of wire within the channel can readily circulate therearound. The drum has a central axle 118 which is mounted in a suitable bearing (not illustrated) secured to the base plates 58 and 59 so that the drum can be rotated at high speed about its central vertical axis. The wire guiding channel 42 extends perpendicular to the central axis of the drum. That is, the channel extends vertically between two planes which are both perpendicular to the rotational axis of the drum. By this arrangement, the vertically extending coil 51 need not twist when passing from the channel 42 into engagement with the outer surface of the drum. This arrangement further ensures that the loops are all driven at a uniform tangential velocity.

The endless belt 46 is preferably made of a strong resilient material such as synthetic rubber. As shown in FIG. 2, the belt yields somewhat where it overlaps the coil 51, and it firmly squeezes the coil against the outer wall of the drum. This positive drive arrangement eliminates any tendency for the loops to slip relative to one another or to slip relative to the drum and belt. Generally, as the size of the wire to be wound increases, greater pulling forces and tension are required to ensure that the turns wound about the core are tight. The positive drive arrangement of the present invention is capable of winding twelve gauge and larger size wire. The positive drive and guidance arrangements of the apparatus are also well suited for propelling coils made of wire of a relatively small gauge size, for example thirty-eight gauge. Of course, depending upon the gauge size of the wire being wound, it may be necessary to vary the depth of the annular recess 114 in the outer wall of the drum. It may also be necessary to change the width of the channel 42 by varying the position of the guide plates.

The wire feeding and braking means 30 and 32 (FIG. 1) are identical and may be of the same construction as those described in U.S. Pat. No. 4,288,041.

The guide tube 40 for the second wire (FIG. 1) approaches the wire guiding channel 42 from beneath the plane of the coil 51 as already explained. The feed end of the guide tube 40 is curved upwardly and inwardly so that the second wire 36 is fed into the wire guiding channel 42 from a location below, and inside the loops of the coil 51. The end of the guide tube 40 passes through the guide plate 70 so that the second wire 36 can be fed into the channel 42 formed between the guide plates 66*b* and 70 as illustrated in FIG. 9. A second guide member 120 (FIGS. 9 and 10) is mounted in a recess in the guide plate 66*b* and has a slot 122 for guiding the wire into the slot 94 in the gap crosser 86 and thence into the wire guiding channel 42 formed between the guide plates 66*a* and 70.

An adjustable wire release means 52 (FIG. 1) is mounted on the guide plate 66*a* adjacent the wire guide channel 42. It consists of a spring loaded wire guide which extends over the top of the channel 42. The peeling wire must lift the guide and compress the spring before it can leave the channel 42. The wire guide may be made from a piece of heavy gauge, resilient wire bent into a U-shape with long legs. The legs are clamped near their loose ends to the guide plate 66*a* such that "U" lies over the channel 42 to prevent wire from exiting. A clamp consisting of a bolt, washer and spring (not illustrated) impinge on the wire guide in such a way that tightening the bolt increases the pressure on the guide.

During the coil winding operation, a wire will initially peel out of the channel 42 adjacent the spring loaded wire release means 52 as illustrated in FIG. 19. The wire, such as 34, will momentarily extend as a chord between the core 48 and a location where the endless belt engages the drum 44. Almost instantly the upperward and radially inward forces exerted by the uppermost loop of the wire 34 are sufficient to urge the guide of the means 52 a sufficient distance to allow the uppermost loop to be pulled from the channel between the guide plate 66*a* and the guide plate 70. As the coil continues to circulate, the uppermost loop of the wire 34 peels away from the drum 44 in a counter-clockwise direction. After the loop of wire has peeled completely away from the drum, it continues to shrink as indicated by the phantom lines in FIG. 20 into a small turn 34' indicated in solid lines of FIG. 20 which is then tightened onto the core. The release means 52 prevents the now-uppermost loop of the coil from peeling away into a chord until the loop previously peeled away has been completely tightened into a turn about the core.

Figure 22:
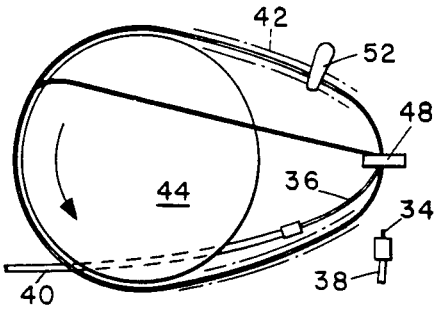
Figure 23:
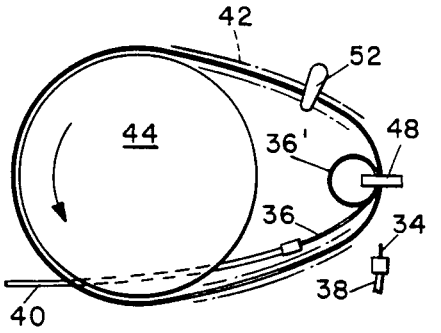

The tightness of each of the turns formed about the core is depended upon how much force is required before a given loop will peel away from the channel from beneath the release means 52. By turning the bolt of the release means 52, the tightness of the turns on the core can be adjusted. The adjustable wire release means 52 operates in a similar fashion when the second wire 36 is wound into turns in the opposite direction about a different angular sector of the core as illustrated in FIGS. 22 and 23.

A rigid guide rod 124 (FIGS. 9 and 10) extends downwardly from the core feeding mechanism and terminates adjacent the core 48 when it is supported in the gap 50 in position for winding. During the core winding operation, the loops of the wire which are peeled out of the channel 42 and away from the drum engage the rod 124 and are guided downwardly thereby. A generally S-shaped guide finger 126 (FIGS. 1, 9 and 10) has one end secured to the base plate 58 and has a forward end which extends into the gap 50. The forward end of the guide finger terminates adjacent the core 48 when the core is in its position for winding illustrated in phantom lines in FIG. 9. The remote end of the guide finger 126 also terminates slightly below and forward of the lower end of the guide rod 124. During the core winding operation, the loops of wire which are peeled out of the channel and away from the drum engage the rod 124 and are guided downwardly thereby. Each turn engages the guide finger 126 which serves to deflect the turn to ensure that it is properly positioned onto the core.

Figure 7:
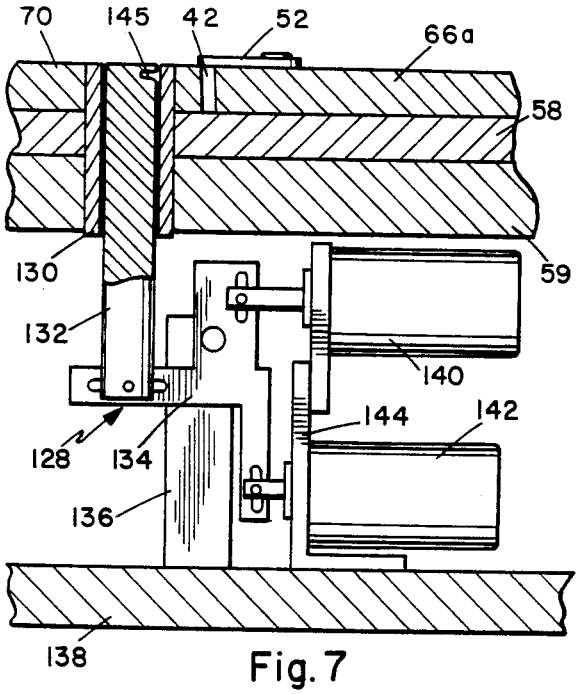
FIG. 7 is a greatly enlarged vertical sectional view taken along line 7—7 of FIG. 1 and illustrating the in-board shear mechanism which cuts the trailing end of the second wire.

A third shear means 128 (FIGS. 7, 8 and 9) extends through the crescent-shaped guide plate 70 opposite the guide plate 66*a*. It includes a cylindrical guide sleeve 130 which extends vertically through the plates 58, 59 and 70. A cylindrical post 132 is vertically reciprocable within the sleeve 130. The lower end of the post 132 is pivotally connected to one end of a T-shaped yoke 134 pivotally mounted to an upstanding member 136 attached to a horizontal shelf 138 connected to the platform structure 54. A pair of solenoids 140 and 142 mounted to a bracket 144 also supported on the cross beam 138 have their actuating arms pivotally connected to opposite legs of the T-shaped yoke 134. The solenoids 140 and 142 operate sequentially in push pull fashion to extend the post 132 to its elevated position illustrated in FIG. 8 and then back again to its retracted position illustrated in FIG. 7.

Figure 8:
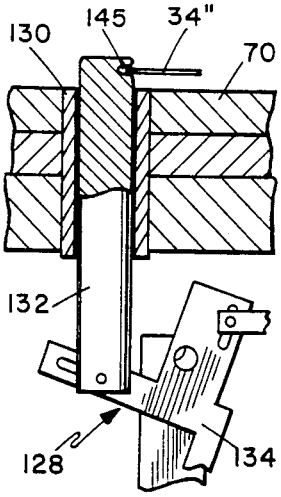
FIG. 8 is a view similar to FIG. 7 illustrating the cutting action of the in-board shear.

The upper end of the post 132 has a groove 145 (FIG. 7) formed therein. As explained hereafter in greater detail, upon completion of the winding of the turns of one of the wire onto the core, the post 132 is extended. The remaining wire, such as 34" in FIG. 8 is engaged by the post 132 in the groove 146 thereof. The wire 34 can then be sheared off from the supply source by energizing one of the solenoids 140 or 142 to retract the post 132 and shear the wire between the post and the sleeve 130. Thus, the third shear means is used to cut off the leading ends of both the first and second wires.

In a shuttleless core winder of this type, it is necessary to form more wire into a coil which is circulated through the core opening than will be ultimately wound about the core. This is because there must be sufficient wire to be driven about the oval-shaped path by the drum and belt during the formation of the last turns about the core. The leading end of a coil is at the bottom of the coil. Therefore, the apparatus of the present invention is provided with a chute mechanism for directing the leading end of each wire downwardly out of the channel. This is done in conjunction with the cutting of the leading end by the third shear means 128.

A chute and gate assembly 146 (FIG. 1) is incorporated in the wire guiding channel 42 in advance of the location where the first and second wires are fed into the channel. The gate which opens the chute and deflects the leading end of the wire downwardly through the platform structure is opened and closed by a solenoid 148 connected to the gate through a linkage 150. The construction and operation of the chute and gate assembly 146 is generally similar to that described in detail in U.S. Pat. No. 4,288,041. The assembly includes a pair of pinch rollers, one of which is continuously driven, and the other one of which is an idler roller which is moved into and out of close proximity with the driven roller to propel the wire therebetween by energization of a solenoid 152 (FIG. 6). Further details of the chute and gate assembly 146 may be obtained by way of reference to U.S. Pat. No. 4,288,041 and in particular, FIGS. 6–8 thereof.

As with the apparatus of U.S. Pat. No. 4,288,041, the present invention preferably includes means for counting each loop as it is peeled from the channel. Such means may include a sensor (not illustrated) which straddles the channel and is positioned adjacent the adjustable release means 52. This sensor is preferably an optical sensor which detects the peeling of the loop as the loop intercepts a scanning beam aimed across the top of the channel. It may include, for example, an LED and a photodiode connected to a conventional electronic counting device (not shown).

Finally, the apparatus of the present invention includes core feeding means 154 illustrated in phantom lines in FIG. 3 for supplying and positioning a succession of cores such as 48 in the gap 50. Once each core is so positioned, the gap crosser can extend through the central opening of the core and the wire can be wound about the core. The core feeding means 154 is not illustrated in FIG. 1 for the sake of clarity, however, it occupies the rectangular region marked in phantom lines on the horizontal shelf 138 attached to the forward end of the platform structure 54. The core feeding means is capable of rotating the core during the winding operation so that the turns of wire are spaced circumferentially thereabout as previously described. The rotation of the core can be reversed during the winding operation to facilitate reverse sector winding.

Figure 12:
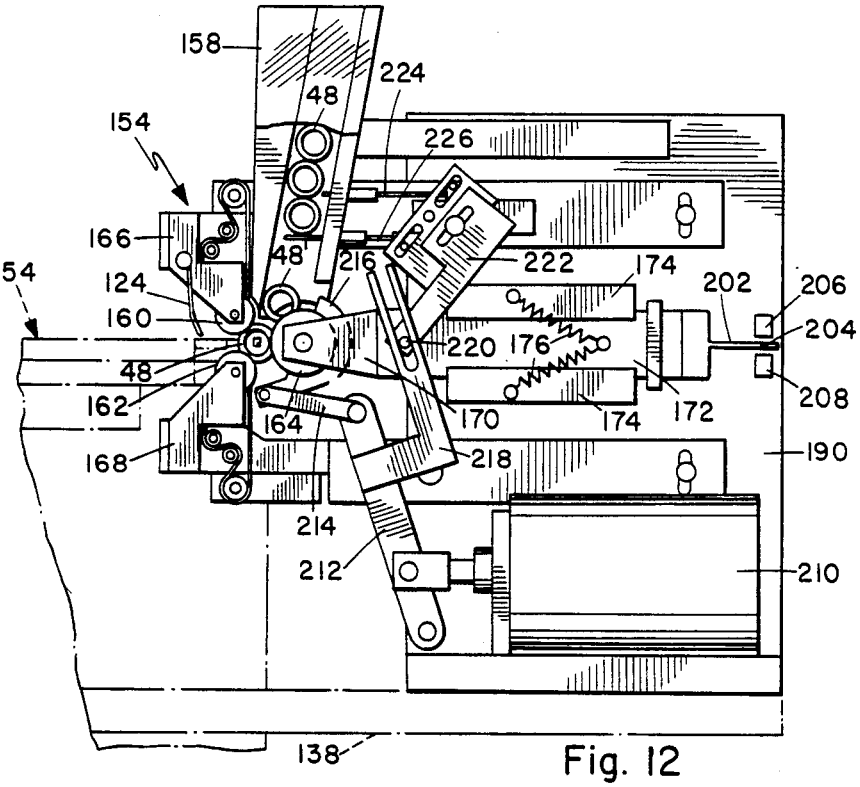
FIG. 12 is an enlarged, side elevation view of the core feeding mechanism.

Details of the structure of the core feeding means 154 are illustrated in FIGS. 12–16. Each wound and completed core is ejected from the gap 50 by displacing the wound core with a new core supplied from an inclined chute 158 (FIG. 12). The new core is supplied in the gap and held firmly in position by three spools 160, 162 and 164. These spools engage the outer periphery of the core at three one-hundred and twenty degree spaced locations. The two front spools 160 and 162 are rotatably mounted on axles extending between upper and lower fixed pairs of triangular support plates 166 and 168. The third spool 164 is rotatably mounted on an axle which extends between trunions 170 on a horizontally reciprocable carriage 172. The carriage 172 is slidably mounted between upper and lower rails 174 (FIG. 12) and is urged toward the gap 50 by springs 176 connected between the rails and the arm.

The spacing between the rims of each of the spools 160, 162 and 164 is slightly larger than the thickness or width of each core. The rims hold the core in lateral alignment with respect to the gap 50. The cylindrical portions of the spools between the rims preferably have an outer surface made of a material having a high coefficient of friction, such as synthetic rubber, so that rotation of a core held between the spools can only occur through rotation of the spools.

Inverted timing belts 178 (FIG. 13) under tension frictionally drive the spools 160 and 162 in the proper directions. The inward facing teeth of each timing belt 178 impinge the outer surface of the core and help to positively drive it through the required amount of rotation. The timing belts 178 are each entrained about idler pulleys 180 (FIG. 13) and about a drive pulley 182, the pulleys being rotatably supported on axles extending between the triangular support plates 166. The axle which carries each drive pulley 182 also carries another drive pulley 184 (FIG. 15) on the opposite end thereof. Drive belts 186 are entrained about each one of the pulleys 184 at one end and about opposite drive pulleys 188 at their other ends.

Figure 15:
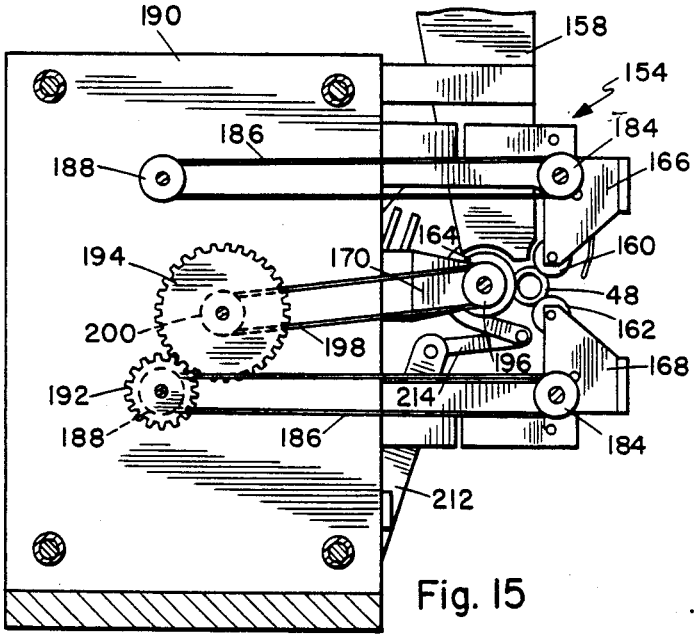
FIG. 15 is a vertical sectional view of the core feeding mechanism taken along line 15—15 of FIG. 14.
Figure 13:
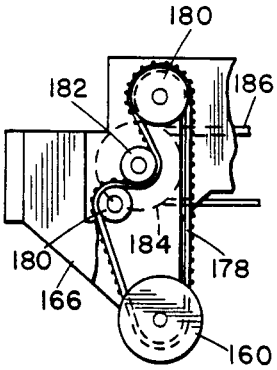
FIG. 13 is an enlarged, fragmentary side elevation view with portions broken away of the belt drive of the core feeding mechanism.
Figure 14:
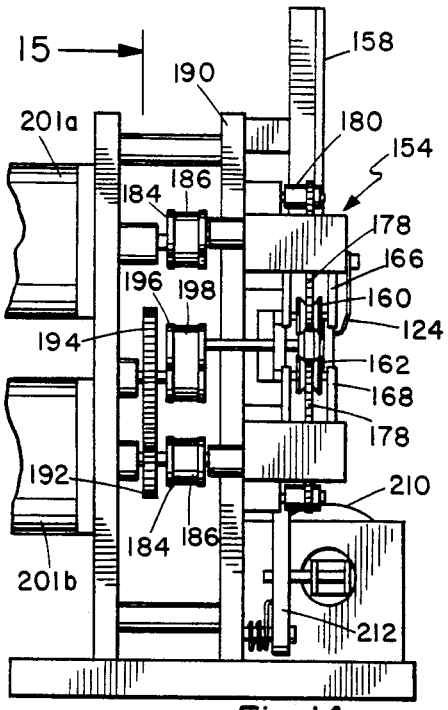
FIG. 14 is a front end elevation view of the core feeding mechanism taken from the left hand side of FIG. 12.

Each of the drive pulleys 188 (FIG. 15) are mounted on horizontal axles mounted between a pair of vertical support plates 190 (FIG. 14). The axle which carries the lower one of the drive pulleys 188 also carries a pinion gear 192 which meshes with and drives a larger star gear 194 also carried on a horizontal axle mounted between the vertical support plates 190. The larger rear spool 164 is carried on an axle mounted between the trunions 170 extending from the forward end of the carriage 172. This same axle also carries a drive pulley 196 (FIG. 15). Another drive belt 198 is entrained about the drive pulley 196 at one end and about another drive pulley 200 at its other end. The drive pulley 200 is carried on the same axle as the star gear 194 and is rotated thereby. Thus, the difference in the diameter of the spools is compensated for in the ratio between the gears 194 and 192 so that a core can be positively driven between the spools without slippage. The upper spool 160 is driven by a motor 201*a* (FIG. 14) and the spools 162 and 164 are driven by a common motor 201*b*.

As previously indicated, the horizontally movable carriage 172 that supports the larger rear spool 164 is spring loaded against the core. The carriage has a fin 202 (FIG. 12) which projects horizontally from the rear end thereof. The fin 202 has an aperture 204 therethrough. An LED 206 and a photodetector 208 are mounted in opposing relationship on the vertical support plate 190 so that the fin 204 can reciprocate therebetween. When the carriage is in its extended core supporting position illustrated in FIG. 12, the aperture 204 in the fin is aligned with the LED and photodetector. Thus, the light from the LED is received by the photodetector and the photodetector generates a signal that indicates that a core is in winding position. When the carriage moves rearwardly to its retracted position to eject a wound core, the retracted position being illustrated in FIG. 16, the solid portion of the fin breaks the light beam from the LED and the photodetector generates a "core eject" signal.

Upon initiation of winding a new core, the core is rotated between the spools in a clockwise direction in FIG. 12 throughout the first sector winding. At completion of the first winding, the core continues to rotate in a clockwise manner to a predetermined second sector starting position. Upon initiation of the winding of the second wire into turns about the core, the core is rotated in a counter-clockwise direction (FIG. 12) throughout the second sector winding. At completion of the second winding, the lower front spool only, rotates clockwise while the rear spool rotates counter-clockwise to eject the core downwardly.

To assist ejection of a wound core, a spring-biased solenoid 210 (FIG. 16) is energized to rotate a pivoting link 212. The lower end of the link 212 is pivotally mounted to one of the vertical support plates 190. The other end of the link 212 is pivotally connected to one end of a floating link 214. The other end of the floating link 214 is pivotally connected to an ejector finger 216 which curves around the upper portion of the large spool 164. When the links described above are in their positions illustrated in FIG. 12, energization of the solenoid 210 causes its actuating arm to retract, moving the links to their positions illustrated in FIG. 16. This causes the end of the curved ejector finger 216 to engage and drive a new core 48' (FIG. 12) downwardly between the spools. The new core 48' forces the wound core 48 downwardly out of the spools into a wound coil bin (not illustrated).

Figure 16:
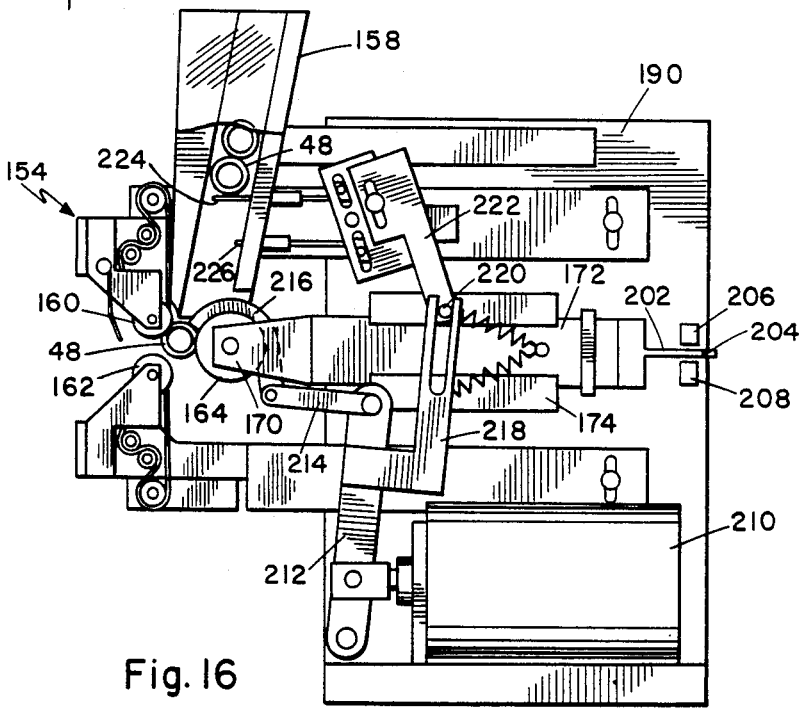
FIG. 16 is a side elevation view of the core feeding mechanism similar to FIG. 12 but with the structural components in different positions to illustrate the feeding of a new core.

When the core feed mechanism is in its state illustrated in FIG. 12, energization of the solenoid 210 also causes the link 212 to move the carriage 172 to its retracted position illustrated in FIG. 16. A lost motion linkage arm 218 is connected at one end to the link 212 and its other end slides about a pin 220 on the forward end of the carriage. Movement of the carriage 172 rearwardly withdraws the spool 164 away from the other spools 160 and 162. This permits the ejector finger 216 to push the new core 48' downwardly between the spools, at the same time forcing the wound core downwardly out of the spools.

Rearward movement of the carriage 172 is also transmitted by a lost motion linkage assembly 222 to move indexing fingers 224 and 226. These fingers move between their positions illustrated in FIGS. 12 and 16 so that only a single new core is dropped from between the fingers into the preload position of core 48' illustrated in FIG. 12. De-energization of the solenoid 210 allows the springs 176 to force the carriage 174 forwardly from its position illustrated in FIG. 16 back to its position illustrated in FIG. 12. The core that was in the preload position is thus gripped between the spools 160, 162 and 164. This same motion also moves indexing fingers 224 and 226 to bring another core into position therebetween.

Thus, the core feeding means is designed so that only one new unwound core rests upon the spools at a time. A plurality of cores can cause jamming during an ejection. Movement of the indexing fingers 222 and 224 allows only one core to drop into a pre-loading position on top of the spools. The motors 201*a* and 201*b* which drive the spools are preferably reversible low-speed high torque stepping motors. Because of the nature of the motors, they also serve as brakes so that the cores cannot be rotated except by the motors. This is particularly helpful at the start of a winding operation when the first turn is tightened onto the core and if the sector requires more than one layer of wire.

The motors, electric clutch/brake assemblies, solenoids, and other electrical devices heretofore described which actuate the operative components of the apparatus described herein, must be sequentially controlled in order for the apparatus to be completely automatic. This control may be accomplished through electromechanical means including relays, limit switches, timers, cams, etc. However, preferably such control is accomplished with the aid of a pre-programmed general purpose computer according to techniques well known in the art of such automated machine control.

Having described in detail the preferred embodiment of our apparatus, the manner in which it may be utilized to accomplish our novel method of multiple reverse sector winding of a toroidal core may now be described. Initially, the motor 76 is energized to start rotation of the drum 44 and the power shafts of the clutch/brake assemblies 30 and 32. The solenoid 90 is energized to retract the gap crosser 86. Thereafter, the core feeding mechanism is actuated to feed a core into the gap into position for winding. Thereafter, the solenoid 90 is de-energized and the gap crosser, which is spring biased, moves back to its extended position through the central opening of the new core. This completes the wire guiding channel 42.

The clutch/brake assembly 30 on the outside of the platform structure 54 is energized to initiate high speed feeding of the first wire strand 34 from its continuous source. Preferably, the spools about which the first and second wire strands are wound are aligned so that the precurvature of the wire resulting from being wound about the supply spools facilitates the formation of these wires into loops in the wire guide channel 42. The guide tube 38 feeds the wire into the tangential slot 94 in the gap crosser and then into the wire guiding channel 42. The first strand of wire 34 travels in a counter-clockwise direction up the one channel leg 42*a*. When the leading end of the first wire 34 reaches the drum 44, it is frictionally held between the outer surface of the drum and the belt 46, and is positively driven about the drum into the other channel leg 42*b*. Continued circulation of the leading end of the first wire strand 34 about the oval-shaped wire guiding channel results in a coil 51 of wire being formed consisting of a plurality of vertically stacked loops.

Figure 21:
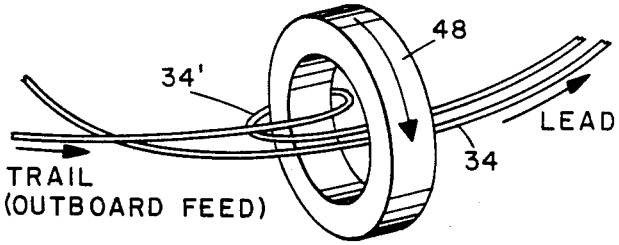

When a sufficient number of loops have been formed in the channel, the clutch/brake assembly 30 is switched to its brake mode. This causes the uppermost loop of the coil of wire 34 to peel away from the channel as illustrated in FIG. 19. Continued driving of the coil by the drum 44 and the belt 46 causes the first loop 34' of the wire to be tightened about the core. Soon after the tightening of the first turn, the core is rotated slightly in a clockwise manner. Also, soon after the first turn is tightened, the solenoid 108 is energized and the trailing end of the first wire 34 is cut off. The coil 51 of the first wire 34 is continuously driven about the oval-shaped path by the drum and belt. The loops of the wire continue to peel away. Each time a loop peels away, an additional turn is wound about the core as illustrated schematically in FIGS. 19, 20 and 21. The tightness of each of the turns is determined by the tension applied by the adjustable wire release means 52. As these turns are formed, the core 48 is rotated in a clockwise direction about its axis by the core feeding means 154.

Shortly before the last turns of the first wire have been wound about the core, the third shear means 128 is actuated to raise the post 132. At the same time, the solenoid 152 is energized to move one of the pinch rollers of the chute and gate assembly 146 adjacent the driven roller. The gate of the chute assembly is pivoted and the leading end of the wire 34 which is being driven around the oval-shaped wire guiding channel 42 is directed downward by the gate, through the chute. Simultaneously, the final turn of the wire 34 is captured in the groove of the post 132 as illustrated in FIG. 8, peeling the wire 34 out of the channel 42. The pinch rollers of the chute and gate assembly 146 pull the wire 34 taut from the chute, around the post 132 to the core 48.

The other one of the solenoids 140 and 142 is then energized, and the rod 132 is retracted, shearing the wire 34. The pinch rollers in the chute and gate assembly 146 then drive the waste wire down through the platform structure 54 into a collection bin. The solenoid 152 is then de-energized separating the pinch rollers and moving the gate back into its normal position. The first wire sector is now complete.

Figure 24:
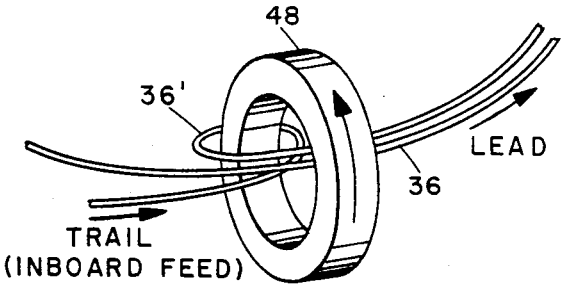

The core is then rotated clockwise by the core feeding mechanism, to a predetermined second starting position. Then the clutch/brake assembly 32 is energized, initiating high speed feeding of the second wire strand 36 through the wire guide tube 40 into the slot 122 (FIG. 10) and then into the wire guiding channel 42. Winding of the second sector proceeds as illustrated in FIGS. 22–24 similar to the winding of the first sector, with the exception being that the core is now rotated counterclockwise during the winding. The trailing end of this second wire is cut by the second shear means at the feed end of the guide tube 40. With the completion of this second winding, the leading end of the second wire is once again cut, and flushed through the chute and gate assembly 146. The completed, reversed sector wound core is then ejected from the core feeding mechanism. This requires that the gap crosser first be retracted. At the same time, a new core is inserted, and the process is repeated.

An actual embodiment of the apparatus described and illustrated herein has been able to wind a coil with two eighty degree sectors, each sector having thirteen turns, wound in reverse directions with respect to each other, with twenty-two gauge wire, and a core of about one-half an inch in outside diameter, such cores being wound at an average of about one every ten seconds.

Having described a preferred embodiment of our method and apparatus, it should be apparent to those skilled in the art that our invention permits of modification in arrangement and detail. Therefore, the protection afforded our invention should only be limited in accordance with the scope of the following claims.

We claim:

1. An apparatus for winding a pair of wires onto a toroidal core having a central opening and an axis which extends through the opening, comprising:

means for supporting and selectively rotating a core about its central axis in a first direction designated clockwise and in a second direction designated counterclockwise;

means for forming a first wire into a first coil having a plurality of loops which circulate through the core opening in a position along a first angular sector of the core that is located slightly counterclockwise from a trailing end of the first wire;

means for braking the trailing end of the first wire while the core is being rotated in a clockwise direction to cause the loops of the first wire to shrink into turns in a first wrapping direction about the first angular sector of the core;

means for forming a second wire into a second coil having a plurality of loops which circulate though the core opening in a position along a second angular sector of the core that is located slightly clockwise from a trailing end of the second wire;

means for braking the trailing end of the second wire while the core is being rotated in a counterclockwise direction to cause the loops of the second wire to shrink into turns in a wrapping direction opposite the first wrapping direction about the second angular sector of the core.

2. An apparatus according to claim 1 and further comprising:

means for cutting the trailing end of the first wire; and means for cutting the trailing end of the second wire.

3. An apparatus according to claim 1 and further comprising:

means for cutting the leading end of the first wire upon completion of the winding of the turns of the first wire onto the core; and means for cutting the leading end of the second wire upon completion of the winding of the turns of the second wire onto the core.

4. An apparatus according to claim 3 and further comprising means for directing the leading ends of the first and second wires out of the apparatus once they have been cut.

5. An apparatus according to claim 1 wherein the apparatus includes:

means for defining a wire guiding channel, the channel extending in a closed curve in a single plane;

means for propelling wire around the channel to form a coil;

means for feeding the first wire into the channel; and means for feeding the second wire into the channel.

6. An apparatus according to claim 5 wherein the channel is oval-shaped.

7. An apparatus according to claim 5 and further comprising:

means for feeding the first wire into the wire feeding channel from a location radially outwardly of the channel and on one side of the plane; and means for feeding the second wire into the channel from a location radially inwardly of the channel and on the other side of the plane.

8. A method for winding a pair of wires onto a toroidal core having a central opening and an axis which extends through the opening, comprising the steps of:

forming a first wire into a coil consisting of a plurality of loops and circulating the loops through the core opening in a position along a first angular sector of the core that is located slightly counterclockwise from a trailing end of the first wire;

rotating the core in a clockwise direction of rotation;

holding the trailing end of the first wire while the core is being rotated in a clockwise direction to cause the loops of the first wire to shrink into turns in a first wrapping direction about the first angular section of the core;

forming a second wire into a second coil consisting of a plurality of loops and circulating the coil of the second wire through the core opening in a position along a second angular sector of the core that is located slightly clockwise from a trailing end of the second wire;

rotating the core in a counterclockwise direction; and holding the trailing end of the second wire while the core is being rotated in a counterclockwise direction to cause the loops of the second wire to shrink into turns in a direction opposite the direction of the first turns about the second angular sector of the core.

* * * * *